US007398774B1

(12) United States Patent
Burnett et al.

(10) Patent No.: US 7,398,774 B1
(45) Date of Patent: Jul. 15, 2008

(54) FORCE BALANCED LINEAR SOLENOID VALVES

(75) Inventors: Keith Burnett, Chatham (CA); Matthew Swinkels, Chatham (CA); Masanobu Tsurumi, Tochigi (JP)

(73) Assignee: Continental Automotive Systems US, Inc., Auburn Hills ( * ) Notice: Subject to any disclaimer, the term of this patent is extended or adjusted under 35 U.S.C. 154(b) by 0 days.

(21) Appl. No.: 11/728,090

(22) Filed: Mar. 23, 2007

Related U.S. Application Data

(60) Provisional application No. 60/885,307, filed on Jan. 17, 2007.

(51) Int. Cl.
*F02B 47/08* (2006.01)
*F02B 47/10* (2006.01)

(52) U.S. Cl. ..... 123/568.26; 123/568.21

(58) Field of Classification Search ..... 123/568.26, 123/568.21, 568.11; 251/129.15, 129.01, 251/129.02

See application file for complete search history.

(56) References Cited

U.S. PATENT DOCUMENTS 5,588,414 A * 12/1996 Hrytzak et al. ..... 123/568.26
5,593,132 A * 1/1997 Hrytzak ..... 251/129.15
5,704,585 A * 1/1998 Hrytzak et al. ..... 251/129.01
5,713,315 A * 2/1998 Jyoutaki et al. ..... 123/90.12
5,722,634 A * 3/1998 Hrytzak et al. ..... 251/129.15
5,911,401 A 6/1999 Hrytzak et al.
5,947,092 A 9/1999 Hussey et al.
5,960,776 A 10/1999 Everingham et al.
6,186,127 B1 2/2001 Everingham

* cited by examiner

*Primary Examiner*—Mahmoud Gimie

(57) ABSTRACT

An electronic exhaust gas recirculation valve for an internal combustion engine selectably provides a recirculation path from engine exhaust to engine intake. A main spring biases the valve in a closed position. The main spring acts on a main spring receiving surface rigidly fixed to a pintle that operates the valve. A solenoid armature is biased against a surface rigidly fixed to the pintle by a spring acting between the pintle and the armature. The armature is permitted to move radially with respect to the pintle for alignment compensation. The main spring force does not affect frictional forces between the armature and the pintle.

20 Claims, 4 Drawing Sheets

FORCE BALANCED LINEAR SOLENOID VALVES

CROSS REFERENCE TO RELATED APPLICATIONS

This application claims the benefit of U.S. Provisional Patent Application Ser. No. 60/885,307 entitled "Force Balanced Linear Solenoid Valves," filed on Jan. 17, 2007, the contents of which are hereby incorporated by reference herein in their entirety.

FIELD OF THE INVENTION

The present invention relates generally to electronic exhaust gas recirculation (EGR) valves, and more particularly, to an electronic EGR valve having an improved construction permitting increased valve closing spring force without significantly increasing valve hysteresis.

BACKGROUND OF THE INVENTION

Controlled engine exhaust gas recirculation is a commonly used technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the induction fuel-air flow entering the engine for combustion so as to limit the combustion temperature and hence reduce the formation of oxides of nitrogen.

Since they are typically engine-mounted, EGR valves are subject to a harsh operating environment that includes wide temperature extremes and vibrations. Exhaust emission requirements impose more stringent demands for improved control of such valves. Use of an electric actuator is one means for obtaining improved control, but in order to be commercially successful, such an actuator must be able to operate properly in such extreme environments for an extended period of usage. Moreover, in mass-production automotive vehicle applications, component cost-effectiveness is also essential. An EGR valve electric actuator that possesses more accurate and quicker response results in improved drivability and fuel economy for a vehicle having an internal combustion engine that is equipped with an EGR system. It also provides better control over tailpipe emissions.

One such EGR system is disclosed in U.S. Pat. No. 5,947,092, issued Sep. 7, 1999 and assigned to the same assignee as the present application. That patent discloses a valve head and valve seat that interact to regulate the recirculation of exhaust gas. The valve head is biased into a closed position in contact with the seat by a helical coil spring acting on a locating member crimped on a stem connected to the valve head. An armature subjected to a magnetic field from a coil acts against the spring to open the valve. A surface of the armature contacts a domed surface of the locating member to transmit valve opening forces. A spring-loaded sensor mounted in a housing of the EGR valve biases the armature against the locating member.

Another arrangement of an EGR system is disclosed in U.S. Pat. No. 5,960,776, issued Oct. 5, 1999 and assigned to the same assignee as the present application. In that arrangement, a replaceable plug mounted to the armature contacts, and is free to slide on, a crowned surface of the valve operating rod. The replaceable plug is used as a calibrating device for the EGR valve, to achieve a desired valve opening at a specified coil energization level.

Details of another known EGR valve arrangement 100 are shown in FIG. 1. An EGR valve having a valve arrangement similar to that of valve arrangement 100 is disclosed in U.S. Pat. No. 5,911,401, issued Jun. 15, 1999, assigned to the same assignee as the present application.

A pintle 136 operates valve elements (not shown) mounted in an enclosure (not shown) for regulating the flow of exhaust gas into the intake manifold. Motion of the pintle 136 is restrained by a bearing guide 102 mounted in the enclosure. A disc-shaped shim 180 is mounted on and abuts a shoulder of the pintle 136. A calibration nut 130 is threaded on a threaded end of the pintle 136, and a lower end of the calibration nut engages the shim 180.

An armature 112 applies an opening force on the pintle 136 in response to a magnetic field applied by an electromagnetic coil 160. A stator 195 provides a magnetic path for the field produced by the coil 160. Between the stator 195 and the armature 112 is a non-magnetic sleeve 190. The sleeve 190 restrains and guides the armature 112 as it moves in response to the magnetic field. The armature 112 and the pintle 136 are therefore independently guided.

The armature 112 has a wall 110 with a central hole 111 through which a shoulder of the calibration nut passes. The hole 111 is large enough to permit movement of the armature relative to the calibration nut, thereby allowing independent movement of the armature with respect to the pintle. The calibration nut 130 compresses a wave spring 140 that biases the armature 112 against a surface of the shim 180. The joint between the armature 112 and the pintle 136 therefore allows the armature 112 to float and find its own center in the sleeve 190, while fixing the armature and pintle in an axial direction to stop movement from applied vibration to the valve.

A main spring 150 mounted in a cup-shaped end 170 of the sleeve 190 biases the pintle to return the valve in a closed position when power is removed from the coil 160. The main spring acts directly on the armature 112. The axial position of the armature with respect to the closed position of the pintle is set by varying the overall length of the shim 180. The position is measured for feedback control by a sensor 120.

As the valve is opened by the pintle 136, the main spring 150 is compressed and the force applied by the main spring increases according to the spring constant. That force acts on the armature 112. The calibration spring 140 must therefore be strong enough to counteract the force of the main spring to maintain contact between the armature and the shim.

Recent valve designs have required higher valve closing forces to be exerted by the main spring. Those forces must be counteracted by higher forces from the calibration spring to maintain the armature in contact with the shim. The resulting increased reaction force between the armature and the shim increases frictional forces and reduces the ability of the armature to float with respect to the pintle, resulting in increased valve hysteresis.

There is therefore presently a need to provide an electronic EGR valve that tolerates a high valve closing force exerted by the main spring 150, while having reduced hysteresis during a valve actuation cycle. Such an EGR valve should also minimize manufacturing costs. To the inventors' knowledge, no such injector is currently available.

SUMMARY OF THE INVENTION

One embodiment of the present invention is an exhaust gas recirculation valve for an internal combustion engine. The valve comprises an enclosure including a combustion air passageway through which combustion air can enter the engine, and an exhaust gas passageway through which engine exhaust gas can be introduced into the combustion air passageway; and an electric-operated exhaust gas recirculation valve for controlling passage of engine exhaust gas into the combustion air passageway.

The valve comprises a valve mechanism disposed within the enclosure for controlling flow of exhaust gas into the combustion air passageway. The valve mechanism including a valve body and a valve seat, one of the valve body and valve seat being rigidly connected to the enclosure.

The valve further includes a pintle having a longitudinal axis, the pintle operably connected to the valve mechanism, movement of the pintle selectively bringing the valve body and valve seat into and out of a contact position to control exhaust gas flow. A main spring receiving surface is rigidly fixed to the pintle, and a main spring contacts the main spring receiving surface, the main spring biasing the valve body against the valve seat in the contact position.

An armature support surface is rigidly fixed to the pintle, the armature support surface being substantially normal to the longitudinal axis of the pintle. An armature includes an armature reaction surface in contact with the armature support surface, the armature being moveable with respect to the pintle while maintaining contact between the armature support surface and the armature reaction surface.

A calibration nut is connected to the pintle, and a calibration spring acts between the calibration nut and the armature, the calibration spring exerting a force biasing the armature support surface against the armature reaction surface. An electromagnetic coil is fixed to the enclosure, the armature being moveable within the coil by magnetic forces exerted by the coil to exert a force on the armature support surface and open the valve mechanism.

The enclosure may further comprise an armature sleeve between the coil and the armature for guiding the armature in reciprocal linear motion. The armature sleeve may further include an enclosure spring seat, the main spring acting between the main spring seating surface and the enclosure spring seat.

A force of the main spring on the pintle may be greater than a force of the calibration spring on the armature.

The calibration nut may be threadedly attached to the pintle. A portion of the calibration nut may extend through a central hole in the armature, the hole providing clearance for the portion of the calibration nut to allow the armature to be moveable with respect to the pintle while maintaining contact between the armature support surface and the armature reaction surface.

The electric exhaust gas recirculation valve may further comprising a disc-shaped shim rigidly fixed to the pintle, the armature support surface and the armature reaction surface being surfaces of the shim. The calibration nut may rigidly fix the shim against a shim support shoulder of the pintle.

Another embodiment of the invention is an electric-operated exhaust gas recirculation valve actuator for actuating a valve mechanism controlling passage of engine exhaust gas into a combustion air passageway of an internal combustion engine. The actuator includes a pintle having a longitudinal axis, the pintle operably connected to the valve mechanism, the pintle having a closed position in which the valve mechanism is closed; a disc-shaped shim rigidly fixed to the pintle, the shim including a main spring receiving surface and an armature support surface; a main spring contacting the main spring receiving surface for biasing the pintle toward the closed position; an armature abutting the armature support surface of the shim permitting relative sliding movement of the armature with respect to the shim; and an electromagnetic coil positioned to apply a magnetic field to the armature, the armature bearing against the armature support surface to move the pintle away from the closed position in response to the magnetic field.

The armature support surface may be substantially normal to the longitudinal axis of the pintle.

The electric-operated exhaust gas recirculation valve actuator may further include a calibration spring exerting a force between the pintle and the armature, the force biasing the armature against the armature support surface. A force of the main spring on the shim may be greater than a force of the calibration spring on the armature. The actuator may further comprise a calibration nut threadedly attached to the pintle, the calibration spring exerting the force on the pintle through the calibration nut. A portion of the calibration nut may extend through a central hole in the armature, the hole providing clearance for the portion of the calibration nut to allow the armature to be moveable with respect to the pintle while maintaining contact between the armature support surface and the armature.

Another embodiment of the invention is a method for actuating an electric-operated exhaust gas recirculation valve controlling passage of engine exhaust gas into a combustion air passageway of an internal combustion engine, the valve including a pintle that, when moved along a longitudinal axis, moves a valve mechanism between open and closed positions. The method includes the steps of applying a closing force to the pintle to bias the valve mechanism to the closed position, the closing force being applied by a main spring contacting a main spring seating surface rigidly connected to the pintle; applying an opening force to the pintle to bias the valve mechanism to the open position, the opening force being applied by applying a magnetic field to an armature connected to the pintle by a floating connection; and applying a seating force to seat the armature in the floating connection, the seating force being applied by a calibration spring acting between the armature and a calibration spring seating shoulder rigidly fixed to the pintle.

The method may further comprise the step of offsetting a longitudinal axis of the armature from the longitudinal axis of the pintle through the floating connection. The main spring seating surface may be a surface of a shim rigidly fixed to the pintle.

The method may also include the step of fixing the shim to the pintle by capturing the shim between a shoulder of the pintle and a calibration nut threadedly attached to the pintle.

The calibration spring seating shoulder may be a shoulder of a calibration nut threadedly attached to the pintle. The closing force may be greater than the seating force.

DESCRIPTION OF THE INVENTION

Figure 1:
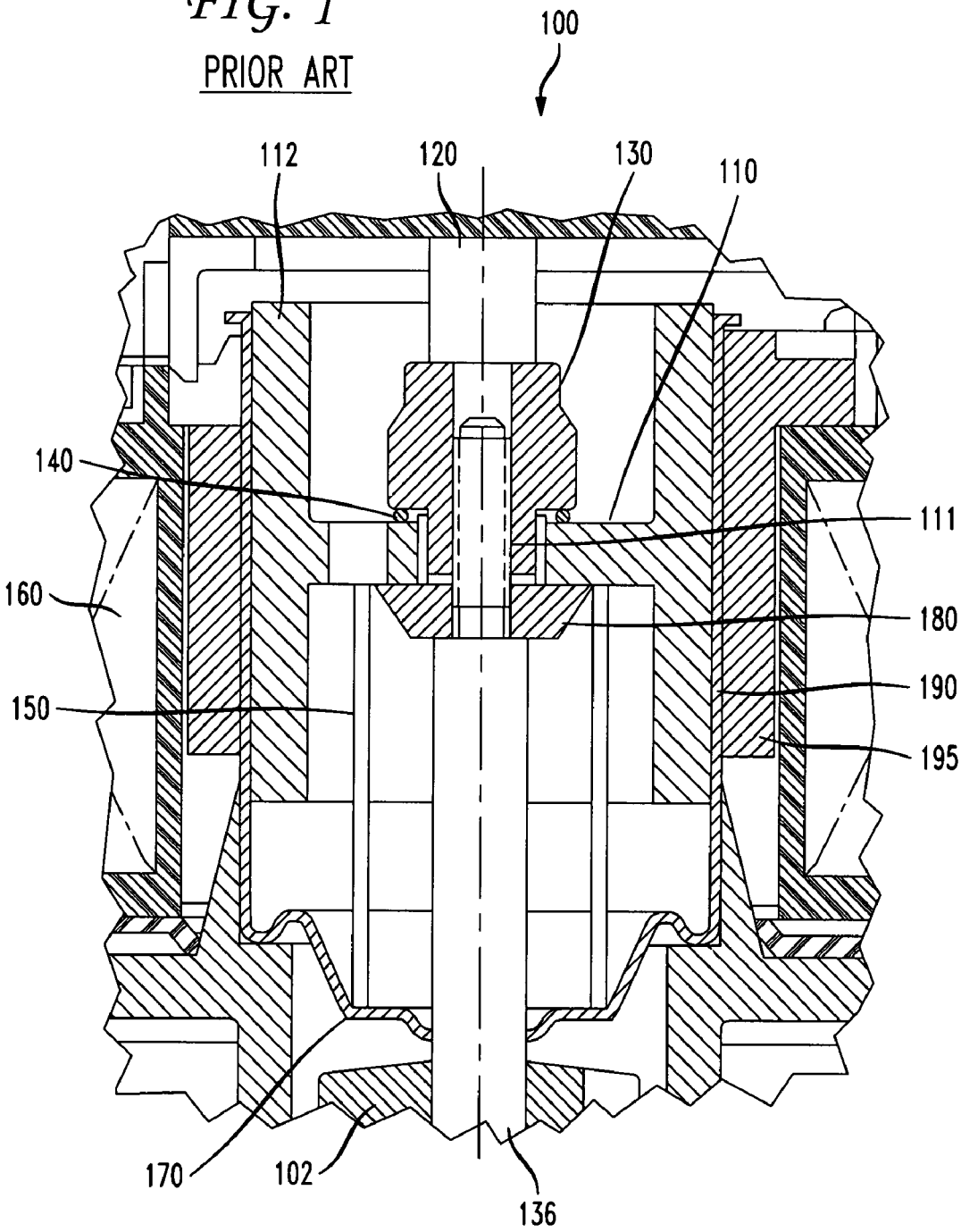
FIG. 1 PRIOR ART
FIG. 1 is a partial sectional view of a prior art valve actuation mechanism of an electronic EGR valve.

An electronic exhaust gas recirculation valve 200 in accordance with the present invention is described with reference to FIGS. 2 & 3. The enclosure of the valve includes a base 201 having an exhaust gas passageway 202 with an entrance 203 coaxial with an axis 205 and an exit 204 that is spaced radially from entrance 203. Both entrance 203 and exit 204 register with respective passages in the engine exhaust manifold (not shown).

The enclosure also includes a shell 216 connected by bolts 217 to the base 201. The shell houses an electromagnetic actuator including an armature 211 and electromagnetic coil 218. A cap 215 provides closure to the upper end of the shell. The cap 215 may be connected to the shell 216 by a clinch ring 245 or by other suitable means.

A valve seat 206 is disposed in the passageway 202 coaxially with entrance 203. The valve seat 206 has an annular shape comprising a through-hole having a frusto-conically tapered surface 206*a*. The seat 206 further has a sealing surface 206*b*. A perimeter flange 207 protrudes from the outside of valve seat 206. The surfaces 206*a* and 206*b* and the flange 207 are concentric. The base 201 is constructed with a valve seat mounting hole that has a counterbore providing a shoulder 208 onto which flange 207 seats. The fit of the valve seat 206 into the base 201 provides a secure, accurate, and gas-tight assembly.

Figure 2:
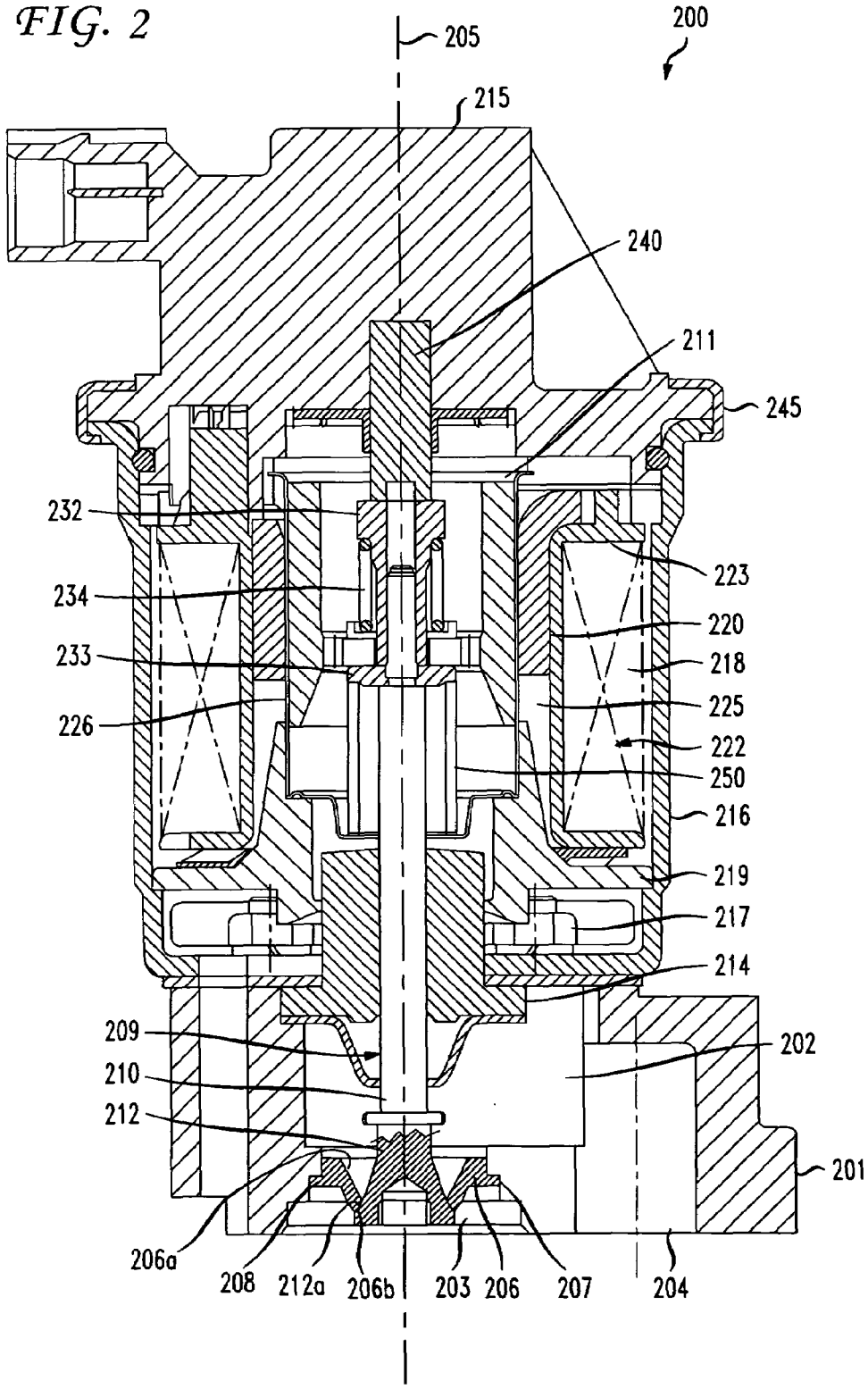
FIG. 2 is a cross sectional view of an electric exhaust gas recirculation valve in accordance with the invention.

FIG. 2 further shows that electronic EGR valve 200 comprises an armature-pintle assembly 209 that is coaxial with axis 205 and that comprises a pintle 210 and an armature 211. The pintle 210 comprises a shaft having a head 212 (FIG. 2) at the lower end and a threaded stud 213 (FIG. 3) at the upper end. The head 212 is shaped for cooperation with the seat 206 while the stud 213 provides for attachment of the pintle to the armature 211.

As shown in FIG. 2, the head 212 has an outer perimeter that is shaped to comprise a frusto-conical tapered surface 212*a* that flares radially outwardly toward a distal end of the head. As can be seen in FIG. 2, which represents the closed or "contact" position of electronic EGR valve 200, surface 212*a* of the pintle head seats against the surface 206*b* of the valve seat. A force on the pintle 210 in an upward direction as oriented in FIG. 2 causes the surfaces 212*a* and 206*b* to seal and thereby close the valve. The closing force is provided by a main spring 250, as described below.

The electronic EGR valve 200 further comprises a bearing guide member 214, mounted in the shell 216. The bearing guide member includes a central bore 218 (FIG. 3) located along the axis 205. The central bore 218 guides and locates the pintle 210 within the EGR valve.

A lower stator member 219 is cooperatively associated with an upper stator member 220 to provide a magnetic circuit that also includes the shell 216. A solenoid coil assembly 222 is disposed within shell 216 between stator members 219 and 220. Solenoid coil assembly 222 comprises a non-metallic bobbin 223 having a straight cylindrical tubular core coaxial with the axis 205, and upper and lower flanges at the opposite axial ends of core. A length of magnet wire is wound on the bobbin 223 to form the electromagnet coil 218.

Accurate relative positioning of the two stator members 219, 220, both axially and radially, is important in achieving the desired air gap 225 in the magnetic circuit that is provided by the two stator members and the shell 216, all of which are ferromagnetic. The stator members are maintained in position axially by the shell 216, and are maintained concentric to the axis 205 by the shell 216 and the bearing guide member 214.

A portion of armature 211 axially spans the air gap 225. A non-magnetic sleeve 226 is disposed in cooperative association with the two stator parts 219, 220 and with the armature 211. The sleeve 226 comprises a straight cylindrical wall that maintains the armature 211 separated from the two stator members. The sleeve 226 also has a lower end wall 227 (FIG. 3) that is shaped for seating on lower stator member 219 and for providing an enclosure spring seat 228 for the helical coil main spring 250. The sleeve 226 has a central hole to clear the shaft of pintle 210 extending from the bearing guide member 214.

Figure 3:
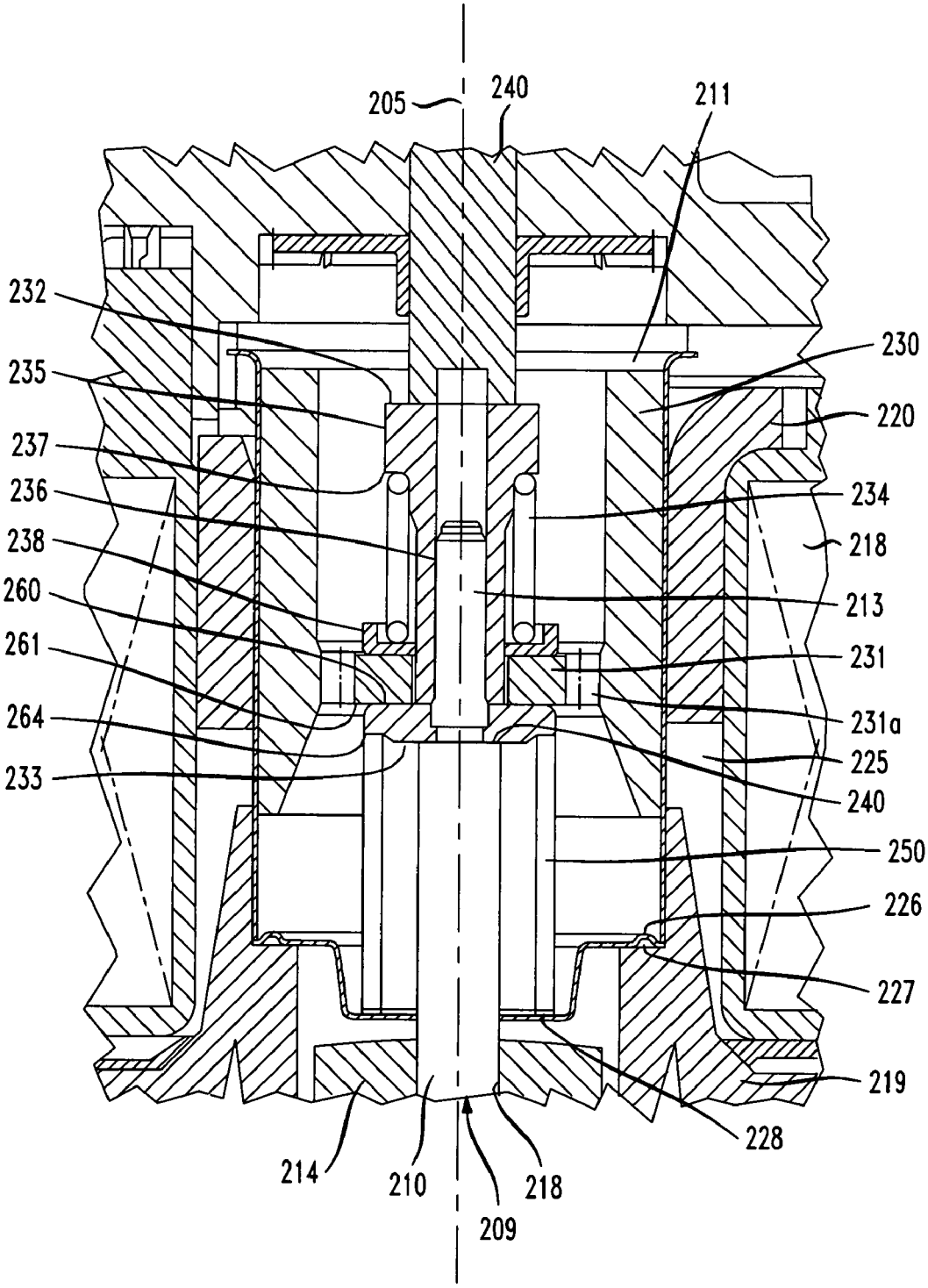
FIG. 3 is an enlarged cross sectional view of the electric exhaust gas recirculation valve of FIG. 2.

As best shown in FIG. 3, the armature 211 is ferromagnetic and comprises a cylindrical wall 230 coaxial with the axis 205 and a transverse internal wall 231 across the interior of wall 230 at about the middle of the axial length of the wall 230. The transverse wall 231 has a central hole that provides for the upper end of pintle 210 to be attached to the armature 211 by a fastening means that includes a calibration nut 232, a shim 233, and a helical calibration spring 234. The wall 231 has three smaller bleed holes 231*a* spaced outwardly from, and uniformly around, its central hole.

The shim 233 is circular in shape having flat, mutually parallel end wall surfaces between which extends a straight circular through-hole that is coaxial with axis 205. The shim includes a recessed main spring receiving surface 264 on one of the end wall surfaces to provide a seat for the main spring 250. Opposite the main spring receiving surface 264 is an armature support surface 260 in contact with an armature reaction surface 261 on the wall 231 of the armature 211. The armature support surface 260 is substantially perpendicular to the axis 205 and the pintle 210. The shim 233 serves four purposes: 1) to provide for passage of the upper end portion of pintle 110; 2) to provide the main spring receiving surface 264 for centering and seating the upper end of the spring 250; 3) to provide the armature support surface to abut the armature; and 4) to set a desired axial position of the armature 211 relative to air gap 225, specifically, relative to lower stator member 219.

The outside diameter of the calibration nut 232 comprises straight cylindrical portion 236 and a larger nut head 235 that may have a cross sectional shape adapted to be turned with a wrench, such as a hexagonal cross section. The straight cylindrical portion 236 of the calibration nut 232 has an outside diameter that provides some radial clearance to the central hole in wall 231 of the armature 211, permitting the armature to move in a radial direction independently of the pintle 210 and the calibration nut 232.

The calibration nut head 235 forms a calibration spring seating shoulder 237 that provides a seat for an upper end of the calibration spring 234. The lower end of the calibration spring is retained by a calibration spring seat 238, which abuts the armature 211. The seat 238 has a central hole that clears the cylindrical portion 236 of the calibration nut 232 sufficiently to permit the seat to move freely in a radial direction with the armature.

The calibration spring 234 may be assembled onto the straight cylindrical portion 236 of the calibration nut 232 prior to threading the calibration nut onto the threaded stud 213 of the pintle. When the calibration nut 232 is threaded onto the threaded stud 213, the calibration spring 234 is axially compressed between the shoulder 237 of the calibration nut and the calibration spring seat 238 abutting the armature 211. The nut is tightened to a condition where the shim 233 is compressed between a shim support shoulder 240 on the pintle 210 just below the stud 213 and the flat lower surface of the calibration nut 232. In the resulting joint, the shim 233 is rigidly fixed to the pintle 210. The term "rigidly fixed" as used herein means that no relative movement of the rigidly fixed components is permitted under normal operating conditions. Once the calibration nut is tightened, the pintle, the calibration nut and the shim are rigidly fixed to each other.

The calibration spring 234 is compressed between the shoulder 237 of the calibration nut and the spring seat 238, biasing the wall 231 of the armature 211 against the shim 233.

That type of joint axially secures the armature 211 to the pintle 210, while allowing the armature 211 to position itself within the sleeve 226 to allow the pintle to be guided by the bearing guide member 214. Hysteresis is reduced by minimizing any side loads transmitted from the pintle to the armature, or from the armature to the pintle, as the valve operates. It may be seen that side loads transmitted from the pintle to the armature depend to a great extent on frictional forces between the shim and the armature, which, in turn, are a function of the force of the calibration spring 234 on the armature.

The armature 211 is accurately axially positioned relative to the air gap 225 by controlling an axial thickness of the shim 233. Specifically, the armature position is controlled with respect to the lower stator member 219. That is done by first measuring the axial distance between the air gap and the valve seat. The axial distance along the pintle 210 between the location where valve head 212 seats on the valve seat 206 and the location where the shoulder 240 of the pintle bears against the shim 233 is then measured. Based on those two measurements, an axial dimension of the shim may be chosen such that the armature, when fastened to the pintle and disposed against the shim, will be in a desired axial position relative to the air gap.

A position sensor 240 is housed within the cap 215. The sensor comprises a plunger that is self-biased against the flat upper end surface of the calibration nut 232. The sensor is accurately calibrated to the axial position of the armature-pintle assembly by setting the axial location of the flat upper end surface of the calibration nut. The axial dimension of the calibration nut is at least a certain minimum. The flat upper surface is ground, as required, to achieve a desired location that will cause plunger to indicate a desired calibration position when abutting the upper end of the calibration nut.

The main spring 250 provides the axial force required to maintain the valve in a closed position; i.e., to maintain the head 212 of the pintle 210 in contact with the valve seat 206. The main spring acts between the seat 228 of the sleeve 226 and the main spring receiving surface 264 of the shim 233.

With greater solenoid forces required in newer electronic EGR valves, the main spring force is also increased. The configuration of the EGR valve of the present invention isolates the main spring force to act between the enclosure and the pintle, without affecting frictional forces between the armature and shim. By acting directly on the main spring receiving surface 264 of the shim, which is rigidly fixed to the pintle 210, the main spring 250 biases the pintle in a valve-closed position without affecting the force between the armature and the shim. The main spring force therefore does not directly contribute to hysteresis caused by relative alignment of the armature and pintle. Instead, frictional forces between the armature and shim, and the resulting hysteresis, are determined by the force exerted by the calibration spring 234.

Further, because the calibration spring need not overcome forces from the main spring, the calibration spring may be designed to have a minimum force required to stop the armature from moving axially when vibration is applied to the valve. Because the calibration spring and main spring do not oppose each other in the presently described valve, the force exerted by the calibration spring may be lower than the force exerted by the main spring. Reducing the calibration spring force reduces frictional forces between the armature and the shim, thereby reducing hysteresis.

Figure 4:
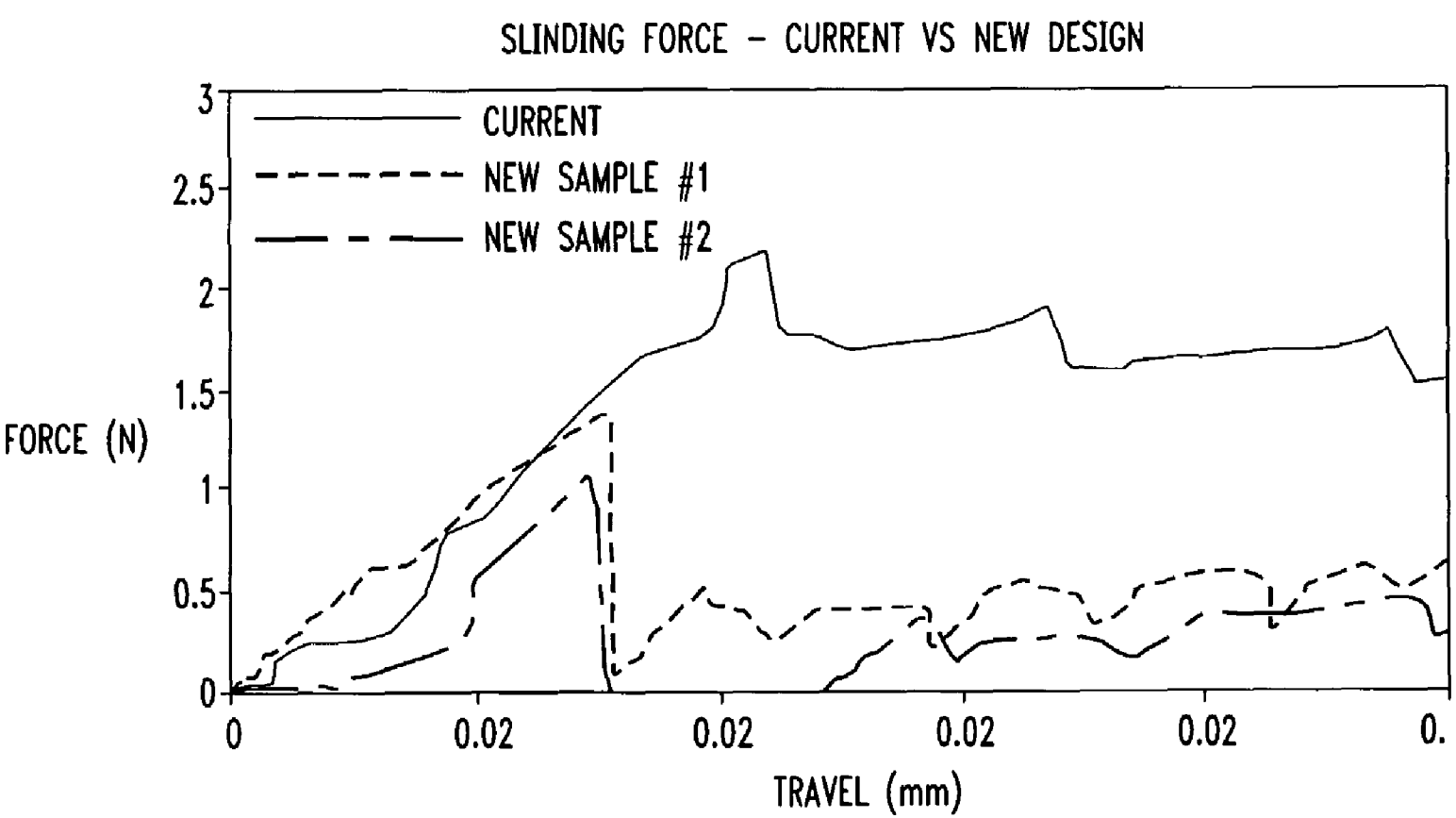
FIG. 4 is a graph illustrating sliding force versus armature displacement for several EGR configurations including that of the present invention.

The diagram of FIG. 4 illustrates a sliding force on the pintles of several sample valves as a function of position or travel of the pintle. A greater sliding force would result in greater hysteresis in actuating the valve.

The fine line represents a prior art valve having a configuration similar to that shown in FIG. 1. It can be seen that the sliding force increases as a function of position until the pintle has traveled about 0.04 mm, where the force levels at just under 2 Newtons. That sliding force is thought to result from increased frictional forces between the armature and shim, inhibiting the compensation for misalignment between the armature and pintle. In contrast to the fine line, the two dashed lines represent samples having the valve configuration of the present invention. After traveling about 0.03 mm, the sliding force of those valves drops off dramatically. It is thought that, once initial stick-slip forces are overcome, the improved alignment compensation of the inventive valve greatly reduces sliding forces.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, one or both of the main and calibration springs of the EGR valve may be Belleville washers or wave springs, instead of helical coil springs. The EGR valve may be housed in a one-piece or two-piece housing, instead of the three piece base/shell/cap design presently described. Numerous other design details of the electronic exhaust gas recirculation valve of the invention may be altered. It is to be understood that the embodiments shown and described herein are only illustrative of the principles of the present invention and that various modifications may be implemented by those skilled in the art without departing from the scope and spirit of the invention.

What is claimed is:

1. An exhaust gas recirculation valve for an internal combustion engine, comprising:

an enclosure including a combustion air passageway through which combustion air can enter the engine, and an exhaust gas passageway through which engine exhaust gas can be introduced into the combustion air passageway; and an electronically-operated exhaust gas recirculation valve for controlling passage of engine exhaust gas into the combustion air passageway, the valve comprising:

a valve mechanism disposed within said enclosure for controlling flow of exhaust gas into the combustion air passageway, said valve mechanism including a valve body and a valve seat, one of the valve body and valve seat being rigidly connected to the enclosure;

a pintle having a longitudinal axis, the pintle operably connected to the valve mechanism, movement of the pintle selectively bringing the valve body and valve seat into and out of a contact position to control exhaust gas flow;

a main spring receiving surface rigidly fixed to the pintle;

a main spring acting on the main spring receiving surface, the main spring biasing the valve body against the valve seat in the contact position;

an armature support surface rigidly fixed to the pintle, the armature support surface being substantially normal to the longitudinal axis of the pintle;

a magnetic armature having an armature reaction surface in contact with the armature support surface, the magnetic armature being moveable with respect to the pintle while maintaining contact between the armature support surface and the armature reaction surface;

a calibration nut connected to the pintle;

a calibration spring acting between the calibration nut and the armature, the calibration spring exerting a force biasing the armature support surface against the armature reaction surface; and an electromagnetic coil fixed to the enclosure, the magnetic armature being moveable within the coil by magnetic forces exerted by the coil to exert a force on the armature support surface and open the valve mechanism.

2. The electric exhaust gas recirculation valve of claim 1, wherein the enclosure further comprises an armature sleeve between the coil and the armature for guiding the armature in reciprocal linear motion.

3. The electric exhaust gas recirculation valve of claim 2, wherein the armature sleeve further comprises an enclosure spring seat, the main spring acting between the main spring seating surface and the enclosure spring seat.

4. The electric exhaust gas recirculation valve of claim 1, wherein a force of the main spring on the pintle is greater than a force of the calibration spring on the armature.

5. The electric exhaust gas recirculation valve of claim 1, wherein the calibration nut is threadedly attached to the pintle.

6. The electric exhaust gas recirculation valve of claim 1, wherein a portion of the calibration nut extends through a central hole in the magnetic armature, the hole providing clearance for the portion of the calibration nut to allow the magnetic armature to be moveable with respect to the pintle while maintaining contact between the armature support surface and the armature reaction surface.

7. The electric exhaust gas recirculation valve of claim 1, further comprising:

a disc-shaped shim rigidly fixed to the pintle, the armature support surface and the armature reaction surface being surfaces of the shim.

8. The electric exhaust gas recirculation valve of claim 7, wherein the calibration nut rigidly fixes the shim against a shim support shoulder of the pintle.

9. An electric-operated exhaust gas recirculation valve actuator for actuating a valve mechanism controlling passage of engine exhaust gas into a combustion air passageway of an internal combustion engine, comprising:

a pintle having a longitudinal axis, the pintle operably connected to the valve mechanism, the pintle having a closed position in which the valve mechanism is closed;

a disc-shaped shim rigidly fixed to the pintle, the shim including a main spring receiving surface and an armature support surface;

a main spring acting on the main spring receiving surface for biasing the pintle toward the closed position;

a magnetic armature abutting the armature support surface of the shim permitting relative sliding movement of the armature with respect to the shim; and an electromagnetic coil positioned to apply a magnetic field to the armature, the armature bearing against the armature support surface to move the pintle away from the closed position in response to the magnetic field.

10. The electric-operated exhaust gas recirculation valve actuator of claim 9, wherein the armature support surface is substantially normal to the longitudinal axis of the pintle.

11. The electric-operated exhaust gas recirculation valve actuator of claim 9, further comprising:

a calibration spring exerting a force between the pintle and the armature, the force biasing the armature against the armature support surface.

12. The electric-operated exhaust gas recirculation valve actuator of claim 11, wherein a force of the main spring on the shim is greater than a force of the calibration spring on the armature.

13. The electric-operated exhaust gas recirculation valve actuator of claim 11, further comprising a calibration nut threadedly attached to the pintle, the calibration spring exerting the force on the pintle through the calibration nut.

14. The electric-operated exhaust gas recirculation valve actuator of claim 13, wherein a portion of the calibration nut extends through a central hole in the magnetic armature, the hole providing clearance for the portion of the calibration nut to allow the magnetic armature to be moveable with respect to the pintle while maintaining contact between the armature support surface and the armature.

15. A method for actuating an electric-operated exhaust gas recirculation valve controlling passage of engine exhaust gas into a combustion air passageway of an internal combustion engine, the valve including a pintle that, when moved along a longitudinal axis, moves a valve mechanism between open and closed positions, the method comprising the steps of:

applying a closing force to the pintle to bias the valve mechanism to the closed position, the closing force being applied by a main spring acting on a main spring seating surface rigidly connected to the pintle;

applying an opening force to the pintle to bias the valve mechanism to the open position, the opening force being applied by applying a magnetic field to an armature connected to the pintle by a floating connection; and applying a seating force to seat the armature in the floating connection, the seating force being applied by a calibration spring acting between the armature and a calibration spring seating shoulder rigidly fixed to the pintle.

16. The method of claim 15, further comprising the step of:

offsetting a longitudinal axis of the armature from the longitudinal axis of the pintle through the floating connection.

17. The method of claim 15, wherein the main spring seating surface is a surface of a shim rigidly fixed to the pintle.

18. The method of claim 17, further comprising the step of:

fixing the shim to the pintle by capturing the shim between a shoulder of the pintle and a calibration nut threadedly attached to the pintle.

19. The method of claim 15, wherein the calibration spring seating shoulder is a shoulder of a calibration nut threadedly attached to the pintle.

20. The method of claim 15, wherein the closing force is greater than the seating force.

* * * * *